US005626334A

United States Patent [19]

Kondo et al.

[11] Patent Number: 5,626,334

[45] Date of Patent: May 6, 1997

[54] DEVICE AND METHOD FOR FEEDING CUT SHEETS OF PAPER IN A ONE-BY-ONE PICKING UP MANNER WITHOUT JAMMING

[75] Inventors: Makoto Kondo; Shigeki Muramatsu, both of Tokyo, Japan

[73] Assignee: NEC Corporation, Japan

[21] Appl. No.: 434,952

[22] Filed: May 4, 1995

[30] Foreign Application Priority Data

May 13, 1994 [JP] Japan ..... 6-124545

[51] Int. Cl.[6] ..... B65H 3/52

[52] U.S. Cl. ..... 271/121; 271/127; 271/160; 271/161; 271/170; 271/171

[58] Field of Search ..... 271/129, 161, 271/160, 171, 169, 170, 121

[56] References Cited

U.S. PATENT DOCUMENTS

| | | | |
|---|---|---|---|
| 1,453,064 | 4/1923 | Danziger | 271/161 |
| 3,857,558 | 12/1974 | Patel | 271/127 |
| 4,231,566 | 11/1980 | Suzuki | 271/170 |
| 4,647,030 | 3/1987 | Tomita | 271/170 |

FOREIGN PATENT DOCUMENTS

| | | | |
|---|---|---|---|
| 0032569 | 3/1978 | Japan | 271/161 |
| 0084733 | 6/1980 | Japan | 271/171 |
| 193834 | 4/1990 | Japan . | |
| 094328 | 3/1992 | Japan | 271/170 |
| 092820 | 4/1993 | Japan | 271/171 |

OTHER PUBLICATIONS

Gunnell, Pre–Buckle Forming Back–up Plate For Supply Cassette, Aug. 1980, IBM Disclosure Bulletin vol. 23 No. 3 pp. 947–948.

*Primary Examiner*—H. Grant Skaggs

*Attorney, Agent, or Firm*—Laff, Whitesel, Conte & Saret, Ltd.

[57] ABSTRACT

To feed a plurality of cut sheets of paper to a recorder, in a one-by-one picking up manner, a stack plate supports the cut sheets placed on a paper stacking side thereof, a spring member is provided on an opposite side to the paper stacking side of the stack plate, a feed roller is rotated to force out in a paper feed direction a top sheet of the cut sheets placed on the stack plate, as the stack plate is elastically urged by the spring member toward the feed roller, a pawl member separates the top sheet from the rest, as it is forced in the paper feed direction by the feed roller, and a convex stripe part is provided on the paper stacking side of the stack plate, the stripe part extending in a crossing direction with the paper feed direction.

13 Claims, 8 Drawing Sheets

DEVICE AND METHOD FOR FEEDING CUT SHEETS OF PAPER IN A ONE-BY-ONE PICKING UP MANNER WITHOUT JAMMING

BACKGROUND OF THE INVENTION

The present invention relates to a device and a method for automatically picking up to feed one by one a plurality of cut sheets of paper without jamming or like feed errors.

In particular, the present invention relates firstly to an automatic paper feed device including a stack plate for placing thereon a plurality of cut sheets of paper, a spring member for upwardly biassing the stack plate, a feed roller for forcing one of the cut sheets to slide and a pawl member for separating that one of the cut sheets to be forced to slide from the rest, secondly to a cut sheet cassette for accommodating therein a plurality of cut sheets of paper, the cassette being cooperative with a paper feed system including a pickup roller rotatable in frictional contact with a top sheet of the cut sheets, to thereby pick up the top sheet from the cassette into the system, and thirdly to a cut sheet feeding method for feeding a plurality of cut sheets of paper in a one-by-one picking up manner from a cut sheet cassette into a paper feed system.

As a basic concept, it has been and is typical for such a device, cassette or method to pick up a top sheet from a neat stack of sheets of paper each cut into a predetermined size such as an A3 (297 mm×420 mm), A4 (210 mm×297 mm) or A5 size (148 mm×210 mm) in an A series or a B4 (257 mm ×364 mm) or B5 (182 mm×257 mm) size in a B series in Japan, or a letter (215.9 mm×279.4), legal (215.9 mm×355.6 mm) or double letter (279.4 mm×431.8 mm) size in the United States of America.

DESCRIPTION OF THE RELATED ART

FIG. 1 shows a typical conventional automatic paper feed device. FIG. 2 is a section along line A—A of FIG. 1.

The conventional device is designated at character 100. The device 100 comprises a cut sheet cassette 101 and a pair of semi-circular feed or pickup rollers 121, 122 fixed on a shaft 120, which is driven by an unshown paper feed system in a recorder such as a printer.

The cassette 101 includes a vertically swingable stack plate 102 for stacking thereon a plurality of cut sheets S of paper, an array of springs 103 provided at a bottom side 102*a* of the plate 102, and a pair of separation pawls 104, 105 for holding both ends of front peripherals of the cut sheets S. The pawls 104, 105 are formed to be integral with a front wall 101*a* of the cassette 101. The springs 103 urge the plate 102 upwards with an elastic force so that, in a pickup phase of a feed cycle, the rollers 121, 122 exert a downward pressure onto the cut sheets S. In that state, a play is left between an end face defined by the front peripherals of the cut sheets S and an inside 101*b* of each pawl 104, 105, i.e. of the front wall 101*a*. As the shaft 120 is driven in a controlled direction R of revolution, a top one S1 of the sheets S on the plate 102 is frictionally forced by the rollers 121, 122 to forwardly slide, like a shown transient state S1(10) thereof, and hits on the inside 101*b* of each pawl 104, 105. As the shaft 120 is still driven, the top sheet S1 upwardly deforms to bulge, like a transient state S1(11), and slips out from under the pawls 104, 105, thus being separated from the rest of the sheets S, like a transient state S1(12), to be picked or drawn up by an unshown pair of feed rollers of the feed system.

In other words, the conventional device 100 comprises a stack plate 102 for supporting a plurality of cut sheets S of paper placed on a paper stacking side thereof, a spring member 108 provided on an opposite side 102*b* to the paper stacking side of the stack plate 102, a feed roller 121 (122) rotatable to force out in a paper feed direction one S1 of the cut sheets S placed on the stack plate 102, as the stack plate 102 is elastically urged by the spring member 103 toward the feed roller 121 (122), and a pawl member 104 (105, 101*a*) for separating that one S1 of the cut sheets S to be picked up, from the rest, as it is forced in the paper feed direction by the feed roller 121 (122).

Such the conventioanl device 100 may however occasionally experience a feed trouble such that, as in FIG. 3A, a front periphery S1*a* of the top sheet S1 in abutment with an inside 101*b* of the pawl member 104 (105, 101*a*) enters a propping state S1(13) between the pawl member 104 (105, 101*a*) and the rest of the sheets S, pushing up the pawl member 104 (105, 101*a*), i.e. pushing down the stack plate 102, in an undesirably backed up manner with the feed roller 121 (122) rotating in a foward direction R. As the roller 121 (122) continues rotation in the direction R, as shown in FIG. 3B, the top sheet S1 is forced to have an upwardly bulging intermediate portion or area S1*b* thereof over-deformed to re-stretch, like a transient state S1(14), thus forwardly long-yielding to be picked up, with the front periphery S1*a* caught under the pawl member 104 (105, 101*a*), causing a paper jam or the like.

To avoid such a trouble, a devised automatic paper feeder has been proposed in the Japanese Patent Application Laying Open Publication No. 193834/1990. The paper feeder employs, in place of a separation pawl, a plate-like elastic member fixed upright to a front end of a cut sheet cassette. As a feed roller rotates in contact with a top sheet of a plurlaity of cut sheets of paper on an upwardly biassed swingable stack plate in the cassette, the top sheet frictionally cooperates with some sheets thereunder to forwardly push an upper end of the elastic member, causing this member to elastically deform from the upright position into a frontwardly angled position, so that the top sheet is separated from other sheets by a rear edge of the upper end of that member.

The paper feeder above however has a disadvantage such that the next sheet that is in frictional contact with the top sheet tends to accompany the top sheet separated from other sheets, thus resulting in an incomplete separation between cut sheets, causing troubles such as a paper jam, an errorneous recognition of size, an errorneous printing, etc.

The present invention has been achieved with such points in mind.

SUMMARY OF THE INVENTION

It is therefore an object of the present invention to provide an improved device by using a simple structure and an improved method by employing a simple step, for feeding a plurality of cut sheets of paper in a one-by-one picking up manner without feed errors such as a paper jam and an incomplete separation of cut sheets.

To achieve the object, a genus of the present invention provides an automatic paper feed device for feeding a plurality of cut sheets of paper to a recorder, in a one-by-one picking up manner. The paper feed device comprises a stack plate, a spring member, a feed roller, a pawl member and a convex stripe part.

The stack plate supports the cut sheets placed on a paper stacking side thereof. The spring member is provided on an opposite side to the paper stacking side of the stack plate. The feed roller is rotatable to force out in a paper feed direction one of the cut sheets placed on the stack plate, as the stack plate is elastically urged by the spring member toward the feed roller. The pawl member separates that one of the cut sheets to be picked up, from the rest, as it is forced in the paper feed direction by the feed roller. The convex stripe part is provided on the paper stacking side of the stack plate. The stripe part extends in a crossing direction with the paper feed direction.

According to the genus of the invention, the stripe part normally gives an assisting deformation to the cut sheets placed on the stack plate.

Accordingly, the cut sheet to be picked up has an increased tendency to deform into a transversely centrally bulged state, as the feed roller rotates. Thus, the cut sheet is permitted to slip out from the pawl member, smoothly sliding ahead, without troubles such as a paper jam and an incomplete separation of cut sheets.

Moreover, to achieve the object described, another genus of the present invention provides a cut sheet cassette for accommodating therein a plurality of neat stacked cut sheets of paper. The cassette is cooperative with a paper feed system including a pickup roller which is rotatable, in a paper pickup phase of a feed cycle of the system, in frictional contact with a top sheet of the cut sheets, to force the same to slide in a forward sense of a substantially longitudinal direction of the cassette that is in accord with a paper feed direction of the system, so that the top sheet can be picked up from the cassette into the system. The cassette comprises a casing member, a stack plate, a downwardly pointing first pickup pawl, a downwardly pointing second pickup pawl, a spring member and a stripe means.

The casing assembly includes a front wall portion which is formed with a front opening having a slightly smaller transverse width than the cut sheets, a rear wall portion, and a side wall portion.

The stack plate is fitted in the casing assembly, in a vertically swingable manner about a rear edge thereof pivoted to the rear wall portion of the casing assembly. The stack plate cooperates with the front wall portion, the rear wall portion and the side wall portion of the casing assembly to define a substantially rectangular parallelepiped stack zone for holding therein the cut sheets, as they are stacked on the stack plate.

The first pickup pawl fronts either of a pair of transverse end regions of a front area of the stack zone from thereabove. The second pickup pawl fronts the other of the transverse end regions of the front area of the stack zone from thereabove.

The spring member normally upwardly biasses the stack plate, providing the same with a tendency to upwardly swing, thus causing the cut sheets to be each rearwardly shifted with a play left between a front periphery thereof and the front wall portion of the casing assembly, while bringing the front periphery of the top sheet into contact with the first and second pickup pawls so that, in the pickup phase of the feed cycle of the system, the first and second pickup pawls frictionally hold both ends of the front periphery of the top sheet, giving them twisting tendencies.

The stripe means is provided on a front portion of the stack plate, for normally giving an upward deformation to an intermediate length of the front periphery of each of the cut sheets so that, in the pickup phase of the feed cycle of the system, the front periphery of the top sheet has along the intermediate length thereof an upwardly deforming tendency induced by each of and intensified by synergism between the upward deformation and the twisting tendencies.

According to this genus of the invention, the top sheet is permitted to slip out from the first and second pickup pawls, smoothly sliding ahead, without troubles such as a paper jam and an incomplete separation of cut sheets.

Further, to achieve the object described, still another genus of the present invention provides a cut sheet feeding method for feeding a plurality of cut sheets of paper in a one-by-one picking up manner from a cut sheet cassette into a paper feed system. The cassette includes a casing assembly composed of a front wall portion formed with a front opening having a slightly smaller transverse width than the cut sheets, a rear wall portion and a side wall portion, and a stack plate fitted in the casing assembly in a vertically swingable manner about a rear edge thereof pivoted to the rear wall portion of the casing assembly. The system includes a pickup roller which is rotatable, in a paper pickup phase of a feed cycle of the system, in frictional contact with a top sheet of the cut sheets to force the same to slide in a forward sense of a substantially longitudinal direction of the cassette that is in accord with a paper feed direction of the system. The method comprising three steps:

In a first step, the cut sheets are accommodated in the cassette, by placing the same in a neat stacked state on the stack plate, to hold the same within a substantially rectangular parallelepiped stack zone defined by a combination of the stack plate and the front wall portion, the rear wall portion and the side wall portion of the casing assembly.

Then, in a second step, the cassette is set up so that a downwardly pointing first pickup pawl fronts either of a pair of transverse end regions of a front area of the stack zone from thereabove, a downwardly pointing second pickup pawl fronts the other of the transverse end regions of the front area of the stack zone from thereabove, a spring member normally upwardly biasses the stack plate, providing the same with a tendency to upwardly swing, causing the cut sheets to be each rearwardly shifted with a play left between a front periphery thereof and the front wall portion of the casing assembly, while bringing the front periphery of the top sheet into contact with the first and second pickup pawls, and a stripe means provided on a front portion of the stack plate normally gives an upward deformation to an intermediate length of the front periphery of each of the cut sheets.

Then, in a third step overlapping the pickup phase of the feed cycle of the system, the pickup roller is rotated so that the first and second pickup pawls frictionally hold both ends of the front periphery of the top sheet, giving them twisting tendencies, and the front periphery of the top sheet has along the intermediate length thereof an upwardly deforming tendency induced by each of and intensified by synergism between the upward deformation and the twisting tendencies.

According to this genus of the invention also, the top sheet is permitted to slip out from the first and second pickup pawls, smoothly sliding ahead, without troubles such as a paper jam and an incomplete separation of cut sheets.

BRIEF DESCRIPTION OF THE DRAWINGS

The objects, features and advantages of the present invention will become more apparent from consideration of the following detailed description, taken in conjunction with the accompanying drawings, in which.

DESCRIPTION OF THE PREFERRED EMBODIMENTS

There will be detailed below preferred embodiments of the present invention, with reference to FIGS. 4 to 15.

Figure 1:
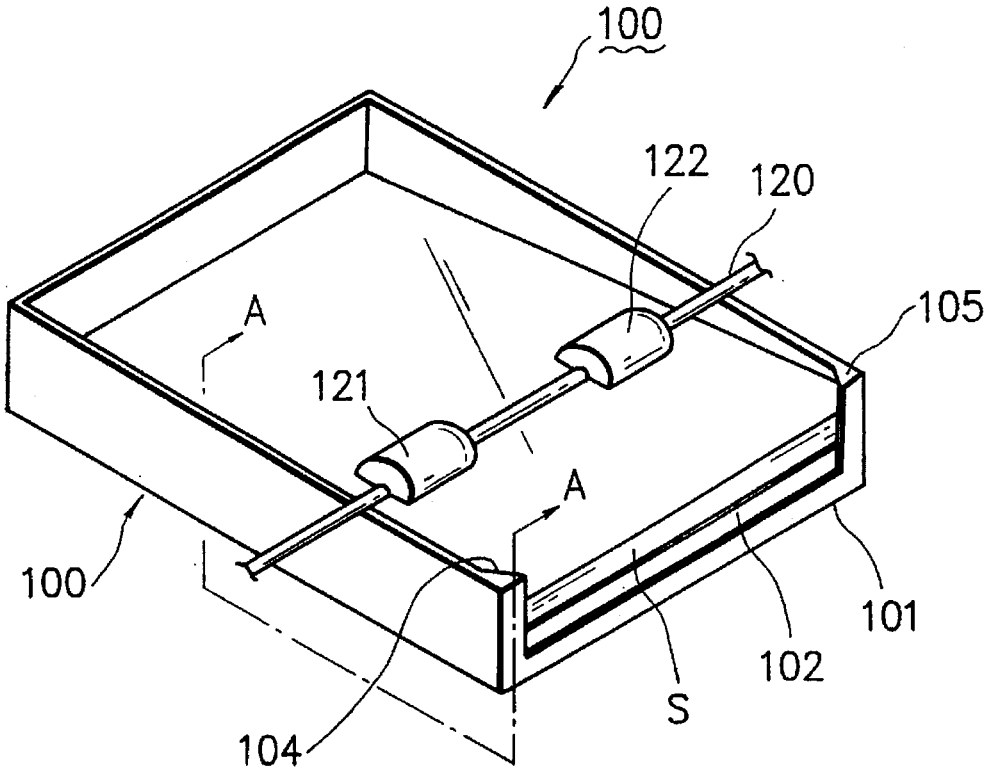
FIG. 1 PRIOR ART
FIG. 1 is a perspective view of a conventional automatic paper feed device, with a neat stack of cut sheets of paper set in position.
Figure 2:
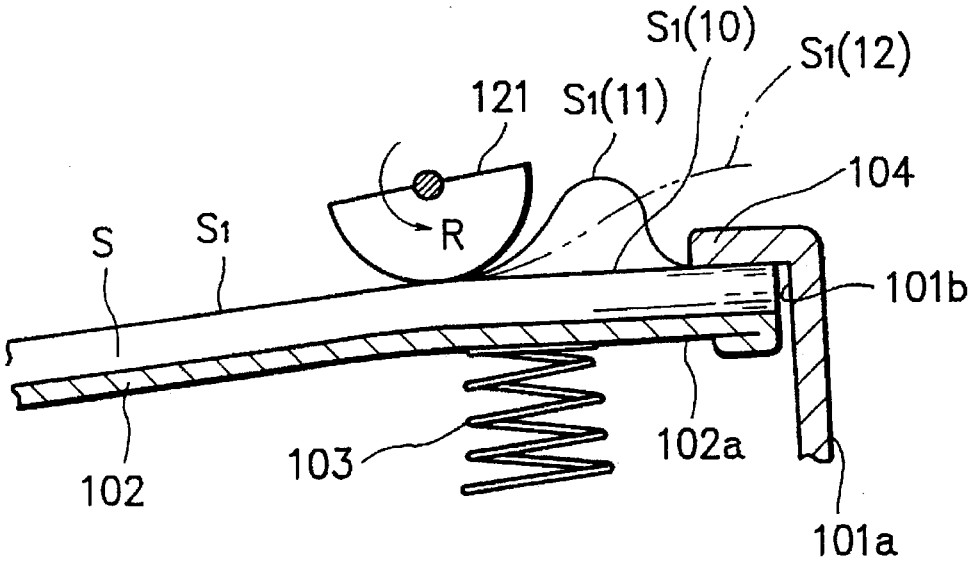
FIG. 2 PRIOR ART
FIG. 2 is an enlarged partial sectional view along line A—A of FIG. 1, showing a transient state of a top sheet in a normal operation of the conventional device.
Figure 3A:
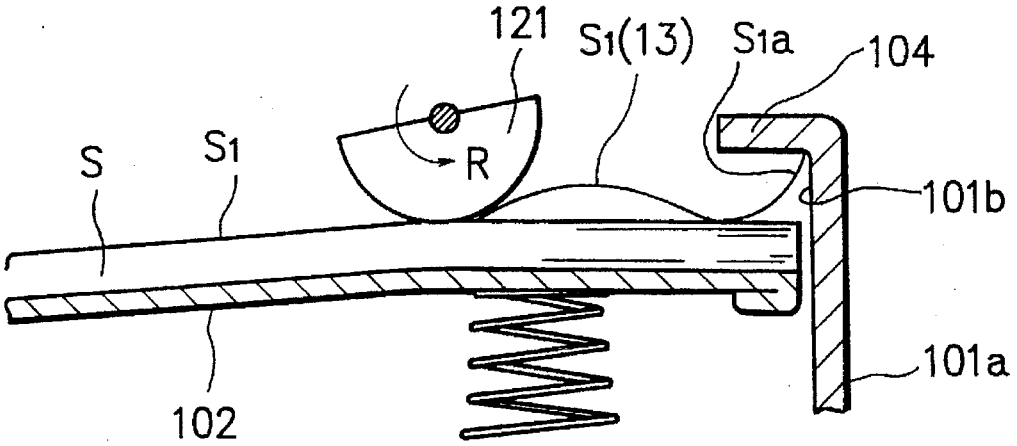
FIG. 3A PRIOR ART
FIGS. 3A and 3B are similar sectional views to FIG. 2, showing transient states of the top sheet in trouble of the conventional device, respectively.
Figure 3B:
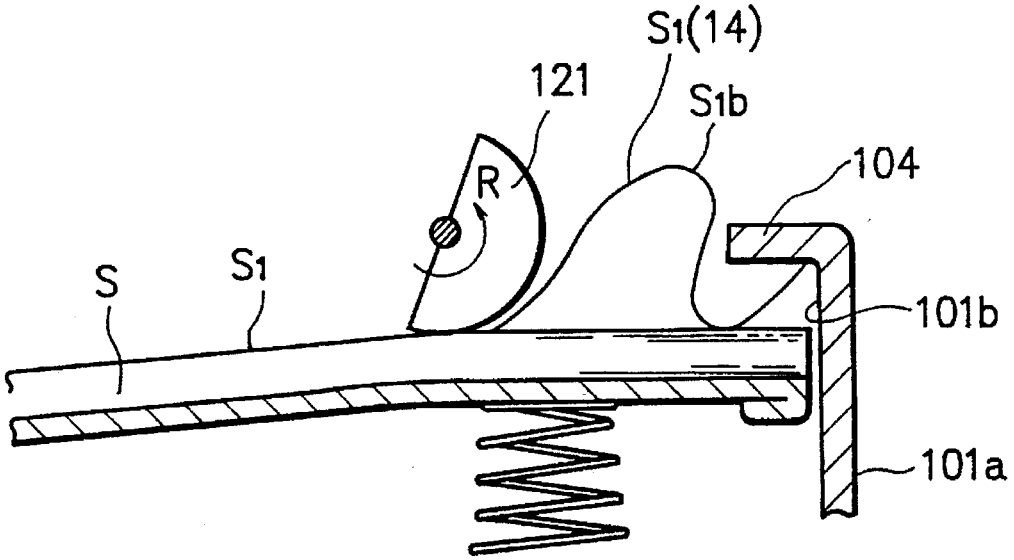
FIG. 3B PRIOR ART
Figure 4:
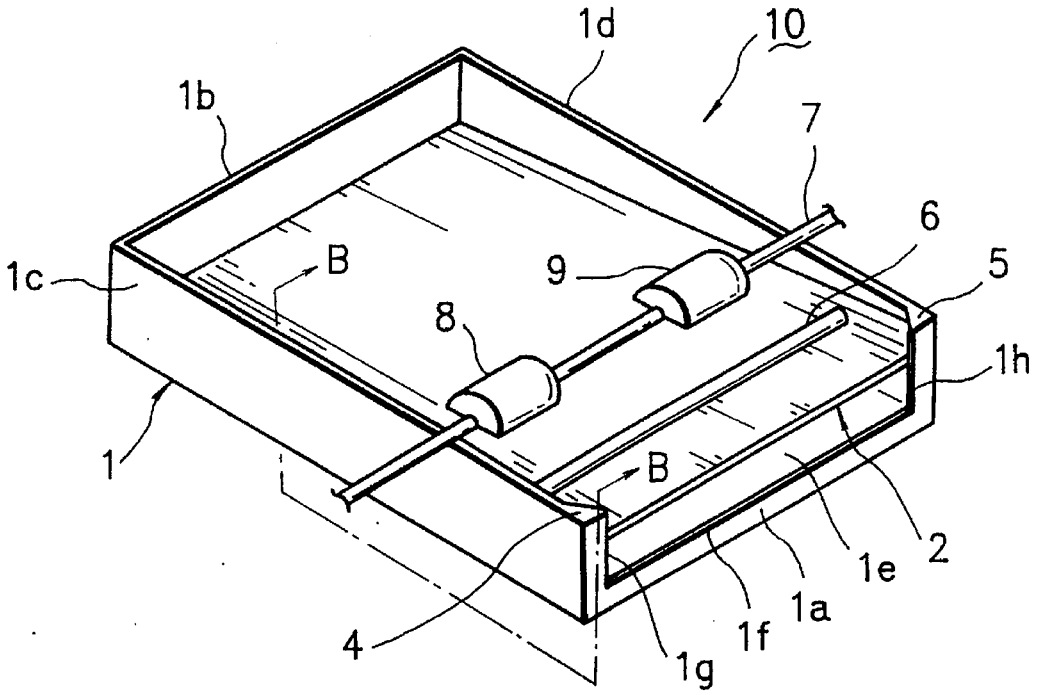
FIG. 4 is a perspective view of an automatic paper feed device according to a first embodiment of the invention.
Figure 5:
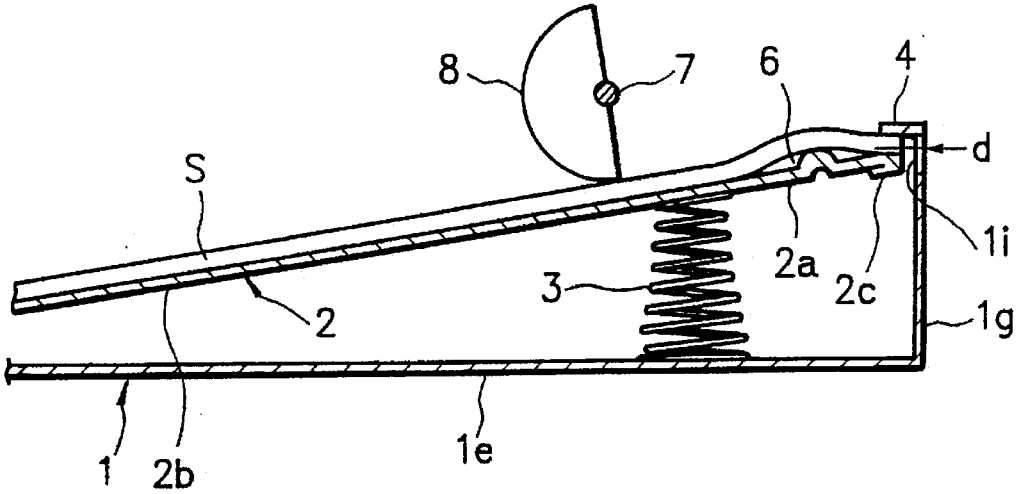
FIG. 5 is an enlarged partial sectional view along line B—B of FIG. 4, with a neat stack of cut sheets of paper set in position.

FIG. 4 shows an automatic paper feed device according to a first embodiment of the invention. FIG. 5 is a section along line B—B of FIG. 4.

The automatic paper feed device according to the first embodiment is designated at character 10. The device 10 comprises a substantially rectangular cut sheet cassette 1 for accommodating therein a neat stack of cut sheets S of paper, and a pair of semi-circular feed or pickup rollers 8, 9 fixed on a drive shaft 7, which is driven by an unshown paper feed system of a recorder such as a printer. The paper feed system has a predetermined paper feed direction, which is in accord with a frontward sense of a longitudinal direction of the device 10, as it is set up in the system. The drive shaft 7 extends transversely of the cassette 1, i.e. perpendicularly to the longitudinal direction of the device 10. The shaft 7 may be assembled to the cassette 1, or separated therefrom to be fitted to the system. The system repeats a paper feed operation with a predetermined feed cycle consisting of a pickup phase for picking up a top sheet of the cut sheets S and a pause period in which the device 10 restores an initial condition.

The cassette 1 has a casing assembly composed of a front wall portion 1*a*, a rear wall portion 1*b*, a left (in front view of the cassette 1) side wall portion 1*c*, a right (in front view of the cassette 1) side wall portion 1*d* and a bottom wall portion 1*e*. The front wall portion 1*a* defines a front opening 1*f* of the cassette 1. The front opening 1*f* has a slightly smaller transverse width than the cut sheets S.

The cassette 1 includes a vertically swingable stack plate 2 for stacking thereon the cut sheets S, an array of springs 3 installed between a front portion 2*a* of the stack plate 2 and the bottom wall portion 1*e* of the casing assembly, a left separation pawl 4 integrally formed with a left end part 1*g* of the front wall portion 1*a* of the casing assembly, and a right separation pawl 5 integrally formed with a right end part 1*h* of the front wall portion 1*a*. The stack plate 2 has substantially the same size in plan as the cut sheets S. The stack plate 2 is pivoted at the rear edge of a rear portion 2*b* thereof to the rear wall portion 1*b* of the casing assembly. The springs 3 urge the stack plate 2 upwards with an elastic force. The semicircular rollers 8, 9 have their diametrical chords directed both to be normal to the stack plate 2, as it is urged to an uppermost position thereof when the system enters the pickup phase of each feed cycle, and rotate in a forward direction before they get inverted to be again normal to the stack plate 2, when the pickup phase ends. When the pickup phase starts, a play d is left between a vertical inside 1*i* of each pawl 4, 5 and an end face defined by the front peripherals of the cut sheets S or a front end 2*c* of the front portion 2*a* of the stack plate 2. During the pickup phase, the rollers 7, 8 exert a downward pressure onto the cut sheets S kept in frictional contact therewith. The left and right separation pawls 4, 5 cooperate with each other to hold both ends of the front peripherals of the cut sheets S.

The stack plate 2 has in the front portion 2*a* thereof a transversely extending upwardly convexed stripe part 6 integrally formed therewith. The stripe part 6 provides each of the cut sheets S placed on the stack plate 2 with an upward normal deformation that assists a complete separation of cut sheets S in the pickup phase of the system.

In other words, the device 10 according to the first embodiment comprises a stack plate 2 for supporting the cut sheets S placed on a paper stacking side thereof, a spring member 3 provided on an opposite side to the paper stacking side of the stack plate 2, a feed roller 8 (9) rotatable to force out in a paper feed direction one of the cut sheets S placed on the stack plate 2, as the stack plate 2 is elastically urged by the spring member 3 toward the feed roller 8 (9), a pawl member 4 (5, 1*a*) for separating that one of the cut sheets S to be picked up, from the rest, as it is forced in the paper feed direction by the feed roller 8 (9), and a convex stripe part 6 provided on the paper stacking side of the stack plate 2, the stripe part 6 extending in a crossing direction with the paper feed direction.

According to the first embodiment, a top sheet to be picked up has an increased tendency to deform into a transversely centrally bulged state, as the feed roller 8 (9) rotates. Thus, the top sheet is permitted to easily slip out from under the pawl member 4 (5, 1*a*), smoothly sliding ahead, without troubles such as a paper jam and an incomplete separation of cut sheets.

Functions of the device 10 will be seen from a detailed description of those of an automatic paper feed device according to a modified example of the first embodiment, as the former is substantially the same as the latter. Moreover, their additional inherent functions will be seen from a detailed description of an eighth embodiment of the invention.

Figure 6A:
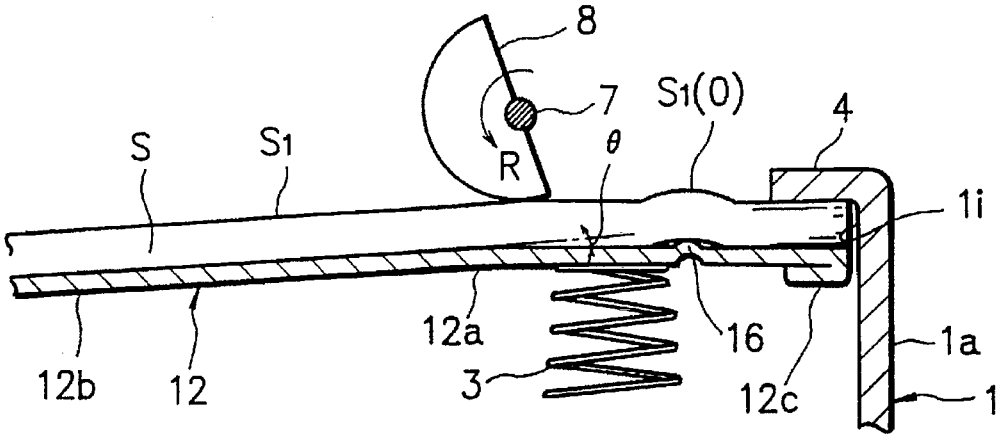
FIGS. 6A, 6B and 6C are similar sectional views to FIG. 5, showing transient states of a top sheet in a pickup phase of a feed cycle of an automatic paper feed device according to a modified example of the first embodiment of the invention, respectively.
Figure 6B:
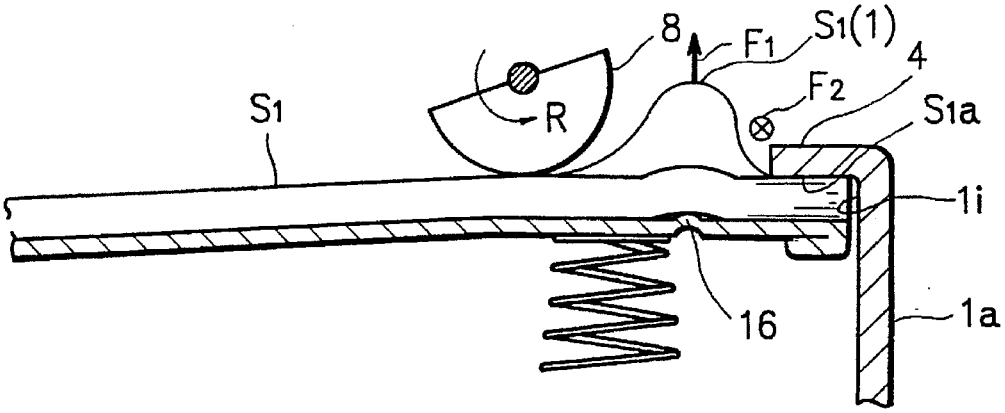
Figure 6C:
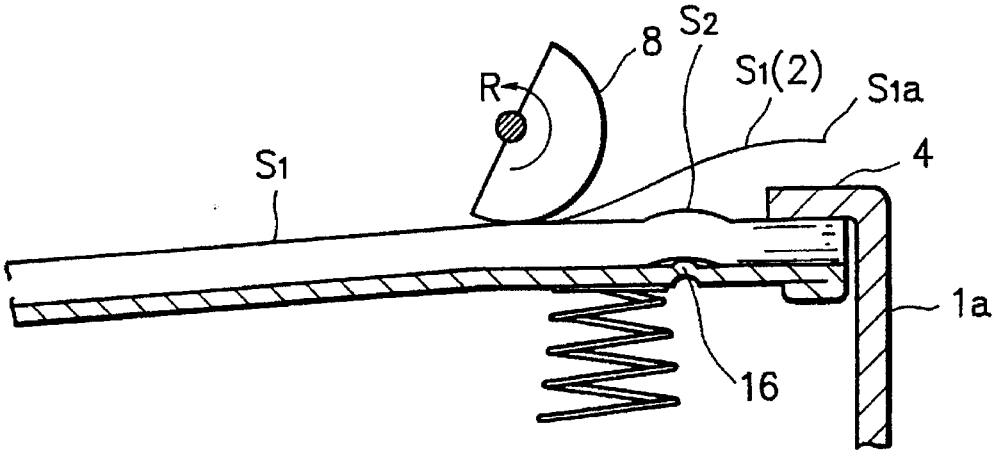

FIGS. 6A, 6B and 6C shows a series of transient states of a top sheet in a pickup phase of the paper feed device according to the modified example. Like parts or members to the first embodiment are designated at like characters to FIGS. 4 and 5, without further description.

Designated at character 12 is a stack plate vertically swingably fitted in a cut sheet cassette 1. The stack plate 12 consists of a front portion 12*a* formed with a transversly extending upwardly convexed stripe part 16, and a slanting rear portion 12*b* with an angle θ relative to the front portion 12*a*. The front portion 12*a* of the stack plate 12 is upwardly urged with a transverse array of of springs 3 installed therebelow. When the cassette 1 is set up in a paper feed system, the front portion 12*a* of the plate 12 has a substantially horizontal position, as it is urged to an uppermost level with a neat stack of cut sheets S of paper placed thereon and held by a pair of separation pawls 4 integrally formed with a front wall portion 1*a* of a casing assembly of the cassette 1, while a play is left between a vertical inside 1*i* of each pawl 4 and a front edge 12*c* of the front portion 12*a* that is flush with a front end face of the cut sheets S.

As in FIG. 6A which corresponds to an initial time of a pickup phase and is concurrently supposed to represent an arbitrary time $t_0$ in an associated vicinity therewith, the cut sheets S are normally upwardly deformed by the stripe part 16 of the stack plate 12 to have an upwardly round-bulged low and smooth or continuuos small deformation transversely extending over a limited length within an effective transverse width of a front opening defined by the front wall portion 1*a* of the cassette 1, like a shown transient state S1(0), so that an inherent re-stretching ability distributed to each definite segmentary element of each sheet is kept, over the entire sheet area including the small deformation, as a varying initial ability within an effective range to recover an original flat state of the sheet. The re-stretching ability is due to the elasticity or tensile recovery force of paper that depends on a varieties of production factors including as a principal one thereof a reference weight which typically is indicated in terms of kilograms per one thousand original sheets before cutting, eg. in terms of kg/1000(A0-size sheets) for the A series cut sheets and kg/1000(B0-size sheets) for the B series sheets. At the time $t_0$, a pair of feed rollers 8 in frictional contact with a top sheet S1 of the cut sheets S are driven by a drive shaft 7 to rotate in a forward direction R of revolution, causing the top sheet S1 to forwardly slide, hitting at the front edge thereof on the vertical inside 1*i* of each pawl 4.

As in FIG. 6B which corresponds to an arbitrary time $t_1$ in an intermediate period of the pickup phase, the roller 8 further rotates in the forward direction R, still in frictional contact with the top sheet S1. As a front peripheral S1*a* of the top sheet S1 is frictionally light-held at both ends thereof under either pawl 4, a front part or area of the top sheet S1 is assisted by the preloaded initial small deformation S1(0) to flexibly bulge out upwards, like a transient state S1(1), in an elastically smooth growing manner, effectively keeping the initial re-stretching ability at each elements of paper. The re-stretching abilities held in respective elements of the bulging deformation S1(1) cooperate with each other to generate tensile forces along elongated paper surface areas, which collectively act on the deformation S1(1) as a combination of an upward repulsive force F1 and a transversely inward pull force F2, thus providing each transverse end of the front periphery S1*a* of the top sheet S1 with a tendency to slip out from under the pawl 4.

As in FIG. 6C which corresponds to an ending time of the pickup phase and is concurrently supposed to represent an arbitrary time $t_2$ in an associated antecedent vicinity relative thereto, the roller 8 is yet rotated in the direction R. As the re-stretching abilities are integrated along growing deformation, the top sheet S1 finally slips out from under the pawls 4 and stretches thereover, like a transient state S1(2), to be picked up by an unshown pair of feed rollers of the paper feed system. Then, the next sheet S2 appears as a subsequent top sheet.

According to the modified example of the first embodiment, as well as to the first embodiment, a plurality of stacked cut sheets 8 on a stack plate 12 (2) each have in a front area thereof a small deformation preloaded by a convex stripe part 16 (6) formed on the stack plate 12 (2) and hence, when a top sheet S1 is forced to forwardly slide by a pair of feed rollers 8 (9) in frictional contact therewith, the front area of the top sheet S1 hitting at a front periphery S1*a* thereof on a vertical inside 1*i* of a pair of separation pawls 4 (5) is effectively assisted by the small deformation to flexibly deform to upwardly bulge out to be picked up, without causing the front periphery S1*a* to prop between an underside of each pawl 4 (5) and a front edge 12*c* (2*c*) of the stack plate 12 (2), thus preventing feed errors such as a paper jam and an incomplete separation of sheets.

The convex stripe part 16 (6) may be a permanently or removably fitted member to the stack plate 12 (2) or may consist of a plurality of divided or subdivided parts each extending in a crossing direction with a paper feed direction, subject to an effective initial re-stretching ability to be reserved in a preloaded deformation by the stripe part. To ensure such an initial ability, an effective measure is implemented as a combination of critical dimensions in a second embodiment of the invention, while the measure is effectively applicable to an arbitrary embodiment of the invention, as well as to an arbitrary modification thereof.

Figure 7:
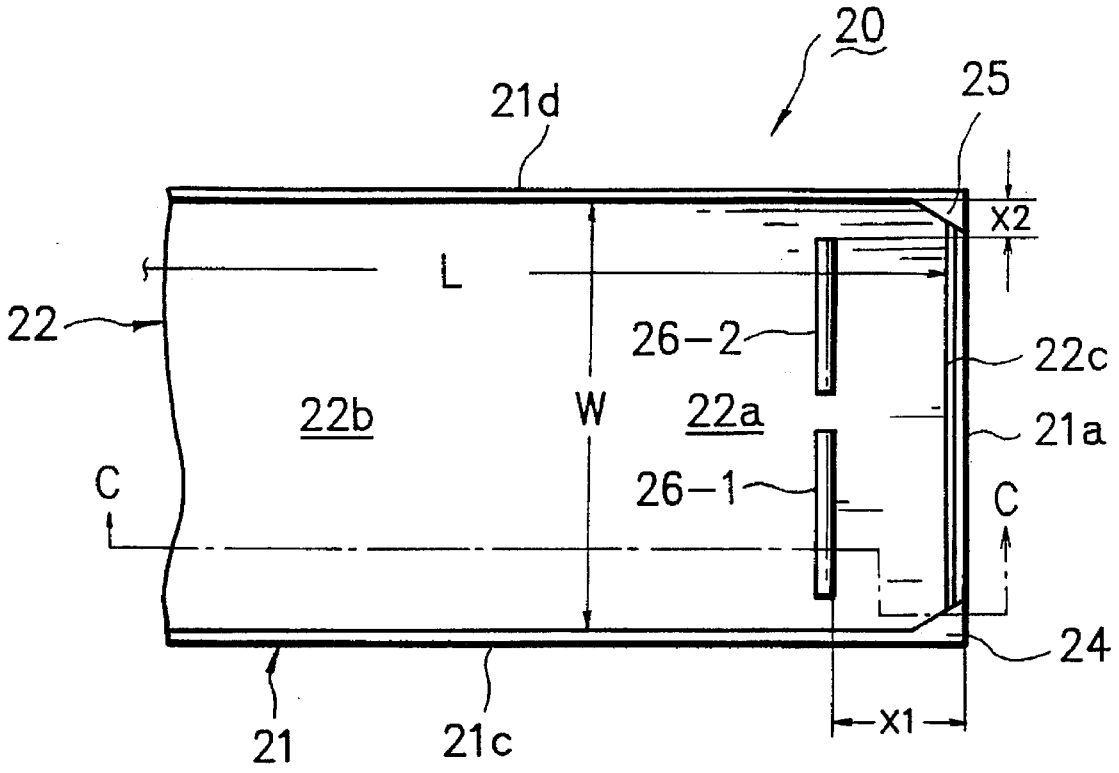
FIG. 7 is a partial plan view of a cut sheet cassette of an automatic paper feed device according to a second embodiment of the invention.
Figure 8:
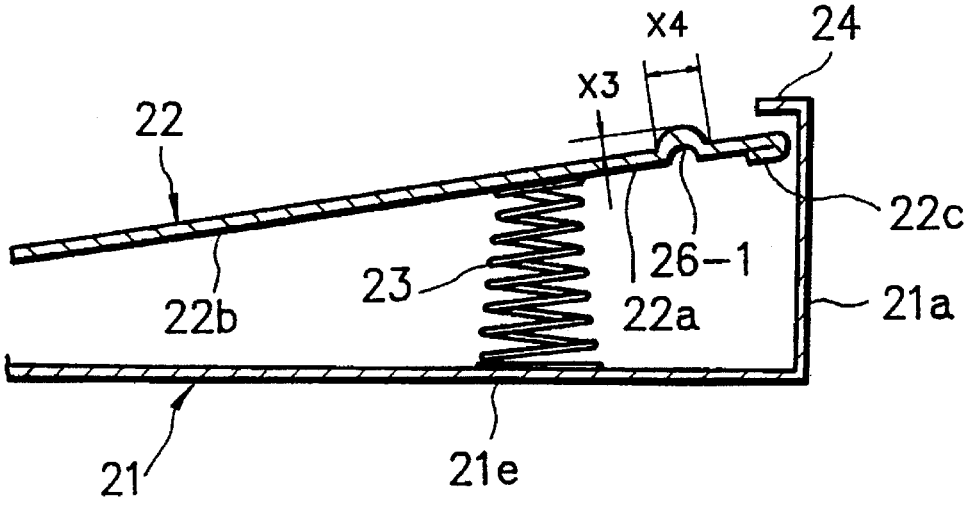
FIG. 8 is a partial sectional view along line C—C of FIG. 7.

FIG. 7 shows a cut sheet cassette of an automatic paper feed device according to the second embodiment. FIG. 8 shows a section along line C—C of FIG. 7.

Designated at character 20 is the cut sheet cassette. The cassette 20 comprises a casing assembly 21, a vertically swingable rectangular stack plate 22 and a transverse array of spring members 23. The casing assembly 21 is substantially the same as that of the first embodiment and comprises a front wall portion 21*a*, an unshown rear wall portion, a left side wall portion 21*c*, a right side wall portion 21*d* and a bottom wall portion 21*e*. The front wall portion 21*a* has a left separation pawl 24 and a right separation pawl 25 both integrally formed thereon. The stack plate 22 has a front portion 22*a* thereof formed with a left upward convex stripe part 26-1 and a right upward convex stripe part 26-2, which both have a semicircular section and extend along an imaginary single transverse line, and a rear portion 22*b* thereof pivoted at the rear edge to the rear wall portion. Each stripe part 26-1. 26-2 is formed round at both opposing sides thereof in a paper feed direction. Each spring member 23 is installed between the front portion 22*a* of the stack plate 22 and the bottom wall portion 21*e* of the casing assembly 21.

The stack plate 21 has an according size to a certain cut sheet of paper: L (longitudinal length)×W (transverse width). The stripe parts 26-1, 26-2 have their front edges at a distance $x_1$ from the front edge of a front periphery 22*c* of the stack plate 22, as it is measured along the upside of the plate 22 or in the paper feed direction. Each stripe part 6-1, 26-2 has its outer end at a distance $x_2$, from a corresponding side edge of the stack plate 22, as it is equal to or larger than a transverse overlapping length in front view of a corresponding one of the pawls 24, 25 over the front portion 22*a* of the plate 22. Each stripe part 26-1, 26-2 has a convex section over a paper stacking side of the plate 22, with a maxmum height of $x_3$ and a maximum width of $x_4$.

The respective dimensions $x_1$, $x_2$, $x_3$, $x_4$ may preferably be determined for sizes of the A series and the B series, as follows.

$x_1$:

10 mm to 20 mm for a sheet stack of A4L;

7 mm to 15 mm for a sheet stack of A4W;

12 mm to 25 mm for a sheet stack of B4L;

8 mm to 17 mm for a sheet stack of B4W;

8 mm to 17 mm for a sheet stack of B5L; and 6 mm to 13 mm for a sheet stack of B5W, where, A4L=297 mm-L×210 mm-W, A4W=210 mm-L×297 mm-W, B4L=364 mm-L×257 mm-W, B4W=257 mm-L×364 mm-W, B5L=257 mm-L×182 mm-W, and B5W=182 mm-L×257 mm-W.

For the letter, legal and double letter sizes, as well as for other sizes, a unit operation may be applied.

$x_2$: at least 5 mm.

$x_3$: 0.3 mm to 0.5 mm for a reference weight between 60 kg to 90 kg in A series, or an equivalent weight thereto.

$x_4$: 1.0 mm to 2.0 mm for a reference weight between 60 kg to 90 kg in A series, or an equivalent weight thereto.

Figure 9:
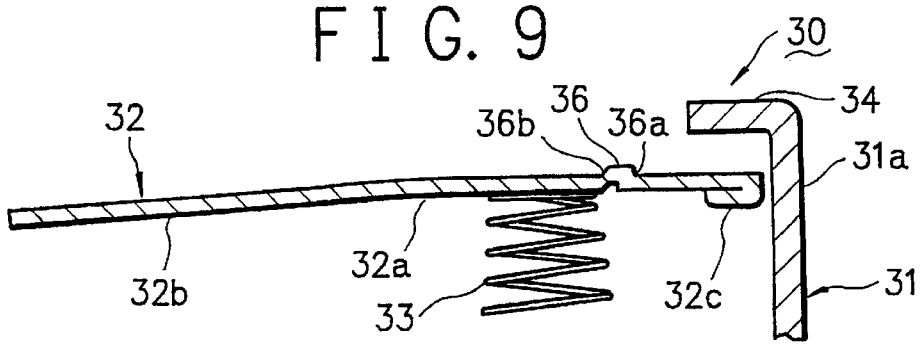
FIG. 9 is a longitudinal partial sectional view of a cut sheet cassette of an automatic paper feed device according to a third embodiment of the invention.

FIG. 9 is a section of an essential part of a cut sheet cassette of an automatic paper feed device according to a third embodiment of the invention.

Designated at character 30 is the cut sheet cassette of the device according to the third embodiment. The cassette 30 comprises a casing assembly 31, a vertically swingable rectangular stack plate 32 and a transverse array of spring members 33. The casing assembly 31 is substantially the same as that of the first embodiment, and comprises a front wall portion 31*a* and unshown rear, side and bottom wall portions. The front wall portion 31*a* has a left separation pawl 34 and an unshown right separation pawl both integrally formed thereon. The stack plate 32 has a front portion 32*a* thereof formed with a transversely extending convex stripe part 36 and a rear portion 32*b* thereof pivoted at the rear edge to the rear wall portion. The rear portion 32*b* has a slanting angle to the front portion 32*a*. Each spring member 33 is installed between the front portion 32*a* of the stack plate 32 and the bottom wall portion of the casing assembly 31.

The stripe part 36 is stepped down at a near side 36*a*thereof to a front periphery 32*c* of the stack plate 32, and is formed round at a far side 36*b*, i.e. at an opposing side 36*b* thereof to a paper feed direction. The stripe part 36 has the same thickness as the front portion 32*a* of the stack plate 32.

Figure 10:
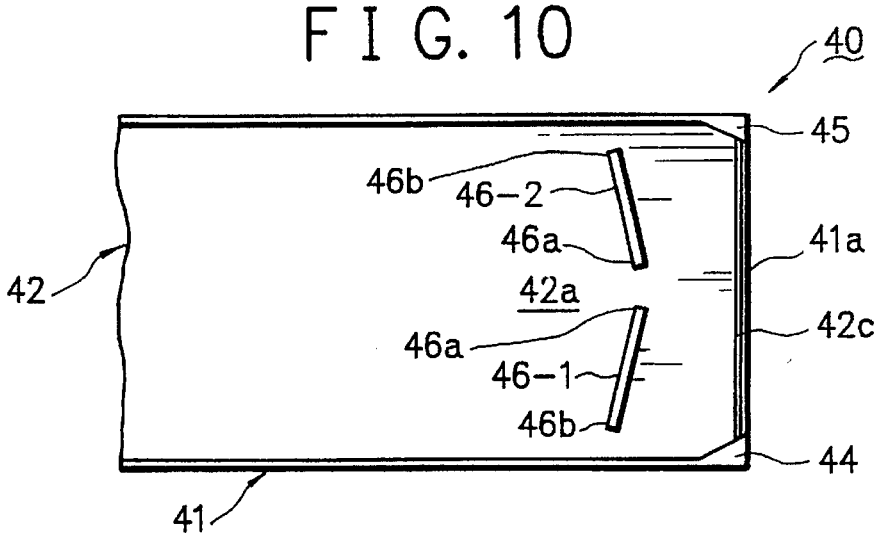
FIG. 10 is a partial plan view of a cut sheet cassette of an automatic paper feed device according to a fourth embodiment of the invention.
Figure 11:
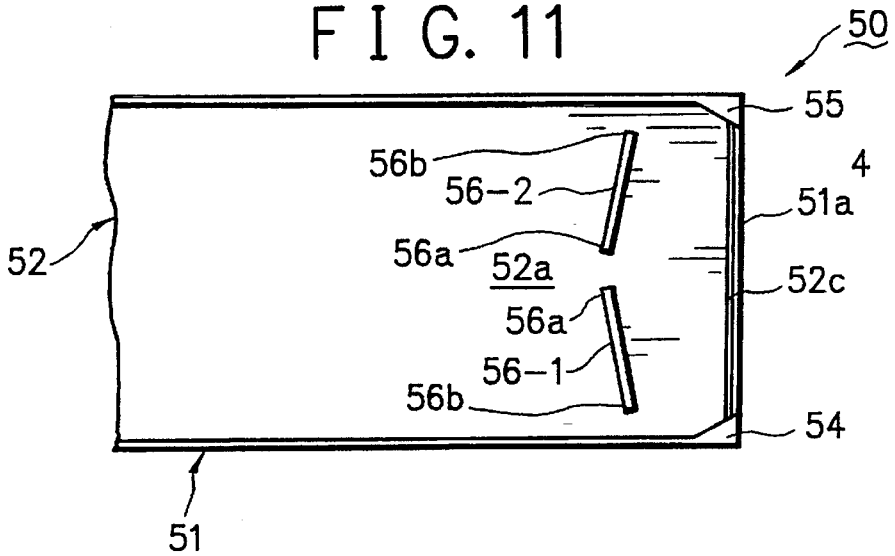
FIG. 11 is a partial plan view of a cut sheet cassette of an automatic paper feed device according to a fifth embodiment of the invention.

FIG. 10 shows a cut sheet cassette of an automatic paper feed device according to a fourth embodiment of the invention, and FIG. 11 shows a cut sheet cassette of an automatic paper feed device according to a fifth embodiment of the invention.

Designated at character 40 is the cut sheet cassette of the device according to the fourth embodiment, and 50 is that of the device according to the fifth embodiment. Each cassette 40; 50 comprises a casing assembly 41; 51, a vertically swingable rectangular stack plate 42; 52 and an unshown transverse array of spring members. The casing assembly 41; 51 is substantially the same as that of the first embodiment, and has a front wall portion 41*a*; 51*a*. The front wall portion 41*a*; 51*a* has a left separation pawl 44; 54 and a right separation pawl 45; 55 both integrally formed thereon.

The stack plate 42;52 has on a front portion 42*a*; 52*a* thereof a pair of convex stripe parts or elements 46-1, 46-2; 56-1, 56-2 symmetrical to each other with respect to an imaginary symmetry axis extending in a paper feed direction.

The stripe elements 46-1, 46-2; 56-1, 56-2 oppose to each other with an angle. The elements 46-1, 46-2 have inner ends 46*a* thereof at a near position to a front periphery 42*c* of the stack plate 42, and outer ends 46*b* thereof at a far position from the front periphery 42*c*. The elements 56-1, 56-2 have outer ends 56*b* thereof at a near position to a front periphery 52*c* of the stack plate 52, and inner ends 56*a* thereof at a far position from the front periphery 52*c*.

Figure 12:
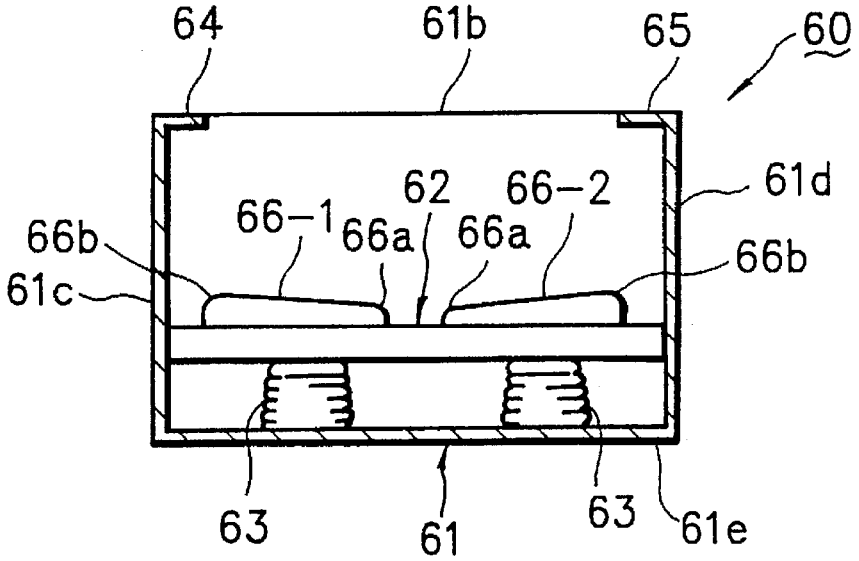
FIG. 12 is a transverse sectional view of a cut sheet cassette of an automatic paper feed device according to a sixth embodiment of the invention.
Figure 13:
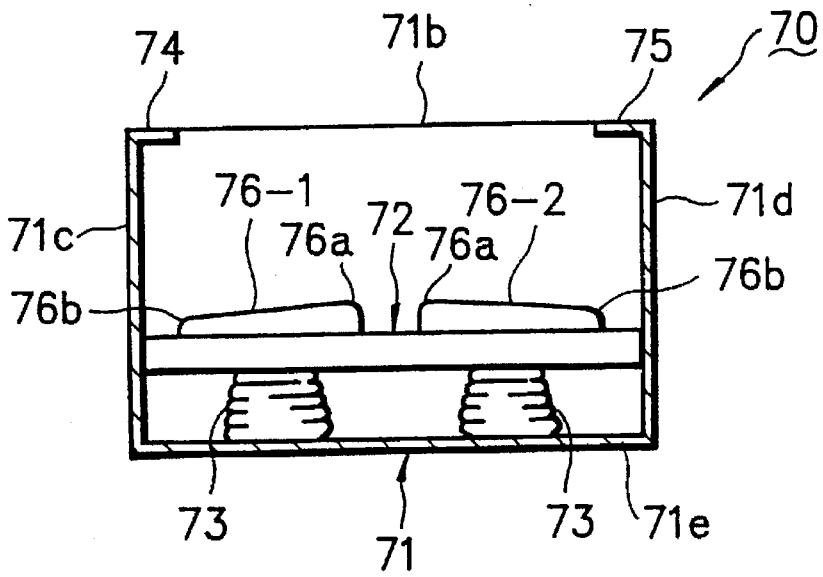
FIG. 13 is a transverse sectional view of a cut sheet cassette of an automatic paper feed device according to a seventh embodiment of the invention.

FIG. 12 shows a cut sheet cassette of an automatic paper feed device according to a sixth embodiment of the invention, and FIG. 13 shows a cut sheet cassette of an automatic paper feed device according to a seventh embodiment of the invention.

Designated at character 60 is the cut sheet cassette of the device according to the sixtth embodiment, and 70 is that of the device according to the seventh embodiment. Each cassette 60; 70 comprises a casing assembly 61; 71, a vertically swingable rectangular stack plate 62; 72 and a transverse array of spring members 63; 73. The casing assembly 61; 71 is substantially the same as that of the first embodiment, and comprises an unshown front wall portion, a rear wall portion 61*b*; 71*b*, a left side wall portion 61*c*; 71*c*, a right side wall portion 61*d*, 71*d* and a bottom wall portion 61*e*; 71*e*. The front wall portion has a left separation pawl 64; 74 and a right separation pawl 65; 75 each integrally formed with the front wall portion and the left or right side wall portion 61*c*, 61*d*; 71*c*, 71*d*.

The stack plate 42; 52 has on a front portion thereof a pair of convex stripe parts or elements 66-1, 66-2: 76-1, 76-2 symmetrical to each other with respect to an imaginary symmetry axis extending in a paper feed direction.

The stripe elements 66-1, 66-2; 76-1, 76-2 oppose to each other on a single straight line or otherwise with an angle. The elements 66-1, 66-2 are each formed to be lower at an near end 66*a* thereof to the symmetry axis than at a far end 66*b* thereof from the symmetry axis. The elements 76-1, 76-2 are each formed to be higher at a near end 76*a* thereof to the symmetry axis than at a far end 76*b* thereof from the symmetry axis.

Figure 14:
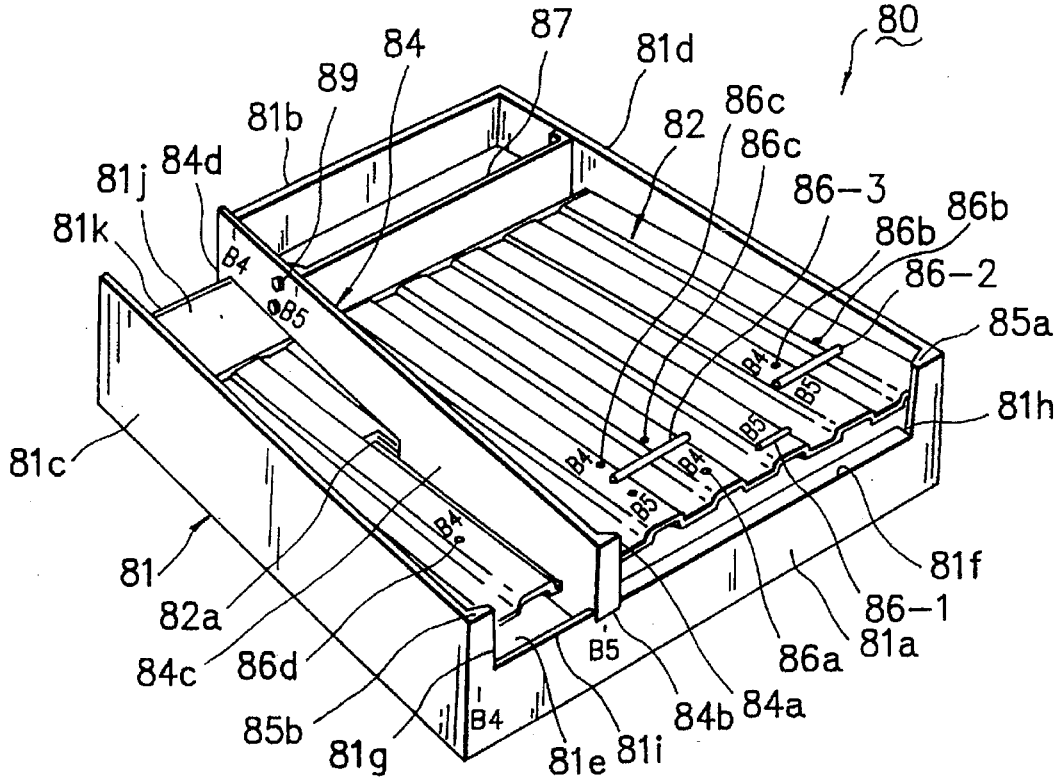
FIG. 14 is a perspective view of a cut sheet cassette according to an eighth embodiment of the invention.

FIG. 14 shows a cut sheet cassette according to an eighth embodiment of the invention.

Designated at character 80 is the cassette according to the eighth embodiment. In operation, the cassette 80 accommodates therein a plurality of neat stacked cut sheets (hereafter S) of paper, which is selectable from between a sheet stack of B4L (hereafter B4) and a sheet stack of B5L (hereafter B5). The cassette 80 is cooperative with an unshown paper feed system that includes a pickup roller which is rotatable, in a paper pickup phase of a feed cycle of the system, in frictional contact with a top sheet (hereafter S1) of the cut sheets S, to force the top sheet S1 to slide in a forward sense of a substantially longitudinal direction of the cassette 80 in accord with a paper feed direction of the system, so that the top sheet S1 can be picked up from the cassette 80 into the system.

The cassette 80 comprises a casing assembly 81, a stack plate 82, a downwardly pointing first pickup pawl 85*a*, a downwardly pointing second pickup pawl 84*a*, a downwardly pointing third pickup pawl 85*b*, a hidden transverse array of spring members (hereafter Sp), and a convex stripe means (hereafter St) in the form of a combination of a bar member 86-1, a first linear member 86-2 and a second linear member 86-3. The bar member 86-1, as well as the linear members 862, 86-3, is detachably attached or removably fixed to a front portion of the stack plate 82, and extends in a perpendicular or crossing direction to or with the longitudinal direction of the cassette 80. The stripe means St may comprise a combination of bar and/or linear members integrally formed with or raised from a stack plate employable for stacking thereon the cut sheets B4, and another combination of bar and/or linear members integrally formed with or raised from another stack plate employable for stacking thereon the cut sheets B5. The stack plate 82 has a wavy configuration in front view thereof to reduce a total frictional coefficient between the upside of the plate 82 and a bottom sheet of the cut sheets S.

The casing assembly 81 comprises a front wall portion 81*a*, a rear wall portion 81*b*, a right side wall portion 81*d*, a left side wall portion 81*c*, a bottom wall portion 81*e*, and a removable side wall member 84. The front wall portion 81*a* is formed with a front opening 81*i* having a slightly smaller transverse width than the cut sheets B4. The front wall portion 81*a* has a right end L-section part 81*h* thereof integrally formed with a front part of the right side wall portion 81*d*, and a left end L-section part 81*g* thereof integrally formed with a front part of the left side wall portion 81*d*. The rear wall portion 81*b* is composed of a rear wall member 81*k* fixed at a lower end thereof to the bottom wall portion 81*e*, a bench member 81*j* fitted between the right and left side wall portions 81*d*, 81*c* and onto the bottom wall portion 81*e*, and a rear partition member 87 removably inserted between a rear part of the right side wall portion 81*d* and a rear part of the side wall member 84 and fitted on a front part of the bench member 81*j*. The partition member 87 may be fixed to the side wall member by a number of bolting pieces 89. The side wall member 84 has a front end part 84*b* thereof rearwardly stepped back at a lower part thereof, and a rear end part 84*d* thereof removably fitted to a back side of the rear wall member 81*k*. The front end part 84*b* of the side wall member 84 is cooperative with a longitudinally reduced and downwardly dent wall edge part of the front wall portion 81*a* to define, when assembled thereto, another front opening 81*f* that has a slightly smaller transverse width than the cut sheets B5.

The stack plate 82 is fitted in the casing assembly 81, and pivoted at a rear edge thereof to the front part of the bench member 81*j* of the rear wall portion 81*b* so that it is vertically swingable about the rear edge thereof.

The stack plate 82 cooperates with the front wall portion 81*a*, the rear partition member 87 of the rear wall portion 81, the right side wall portion 81*d* and the side wall member 84 of the casing assembly 81 to define a substantially rectangular parallelepiped stack zone (hereafter Z5) for holding therein the cut sheets B5, as they are stacked on the stack plate 82.

Moreover, the stack plate 82 cooperates with the front wall portion 81*a*, the rear wall member 81*k* and the bench member 81*j* of the rear wall portion 81, the right side wall portion 81*d* and the left side wall portion 81*c* of the casing assembly 81 to define a substantially rectangular parallelepiped stack zone (hereafter Z4) for holding therein the cut sheets B4, as they are stacked on the stack plate 82 and the bench member 81*j*.

The side wall member 84 has an engagement part 84*c* vertically loose engageable with a longitudinal groove 82*a* cut in the stack plate 82, permitting the stack plate 82 to vertically swing within a requisite angle range.

Accordingly, the cassette 80 is implemented to provide a stack zone having a variable total area at least between a first total area, as that of the stack zone Z4, defined by a combination of the front wall portion 81*a*, the right side wall portion 81*d*, the left side wall portion 81*c* and the rear wall member 81*k* and a second total area, as that of the stack zone Z5, defined by a combination of the front wall portion 81*a*, the right side wall portion 81*d*, the side wall member 84 and the rear partition member 87.

The first pickup pawl 85*a* is integrally formed at the top of the right end part 81*h* of the front wall portion 81*a*, and fronts from above a right end region of a front area of the stack zone Z4 or a right end region of a front area of the stack zone Z5.

The second pickup pawl 84*a* is integrally formed at the top of the front end part 84*b* of the side wall member 84, and fronts from above a left end region of the front area of the stack zone Z5.

The third pickup pawl 85*b* is integrally formed at the top of the left end part 81*g* of the front wall portion 81*a*, and fronts from above a left end region of the front area of the stack zone Z4.

The spring members Sp normally upwardly bias the stack plate 82, providing the plate 82 with a tendency to upwardly swing, causing the cut sheets S to be each rearwardly shifted with a play left between a front periphery (as a front area with a longitudinal width) of the sheet and the front wall portion 81*a* of the casing assembly 81, while bringing the front periphery of the top sheet S1 into contact with the first and second pickup pawls 85*a*, 84*a* (or the first and third pickup pawls 85*a*, 85*b*) so that, in the pickup phase of the feed cycle of the system, the first and second pickup pawls 85*a*, 84*a* (or the first and third pickup pawls 85*a*, 85*b*) frictionally hold both ends of the front periphery of the top sheet S1, giving them twisting tendencies.

The stripe means St is provided on a front portion of the stack plate 82, for normally giving an upward deformation to an intermediate length of the front periphery of each of the cut sheets S so that, in the pickup phase of the feed cycle of the system, the front periphery of the top sheet S1 has along the intermediate length thereof an upwardly deforming tendency induced by each of and intensified by synergism between the upward deformation and the twisting tendencies.

In this connection, to permit a manual conversion of stripe positioning betwen the stack zones Z5 and Z4, the stack plate 82 has in the front portion thereof a plurality of central fixing holes (one under the member 86-1, another designated at 86*a*, others unshown) identified by associated printings (such as B5, B4) and arranged substantially in a nearly transversely leftwardly crossing direction with the longitudinal direction of the cassette 80. The bar member 86-1 is detachably fixed to one of the central fixing holes. The central fixing holes may be replaced by a voluntary fixing means for removably fixing the bar member 86-1.

The stack plate 82 further has in the front portion thereof a plurality of pairs of first auxiliary fixing holes (one pair under the member 86-2, another pair designated at 86*b*, 86*b*, others unshown) identified by associated printings (such as B5, B4) and arranged substantially in a nearly longitudinally rightwardly crossing direction with the longitudinal direction of the cassette 80 within a neighboring region to a right transverse end region of the front area of the stack zone Z5 and hence of the front area of the stack zone Z4. The first linear member 86-2 is detachably fixed to one of the first auxiliary fixing hole pairs. The first auxiliary fixing hole pairs may be replaced by a voluntary fixing means for removably fixing the linear member 86-2.

The stack plate 82 still has a plurality of pairs of second auxiliary fixing holes (one under the member 86-3, another pair designated at 86*c*, 86*c*, others unshown) identified by associated printings (such as B5, B4) and arranged substantially in a nearly longitudinally leftwardly crossing direction with the longitudinal direction of the cassette 80 within a neighboring region to a left transverse end region of the front area of the stack zone Z5. The stack plate 82 yet has a plurality of pairs of third auxiliary fixing holes (one pair having a right hole thereof designated at 86*d*, another pair unshown) identified by associated printings (such as B4) and arranged substantially in a nearly longitudinally leftwardly crossing direction with the longitudinal direction of the cassette 80 within a neighboring region to a left transverse end region of the front area of the stack zone Z4. The second linear member 86-3 is detachably fixed to one of the second and third auxiliary fixing hole pairs. The second and third auxiliary fixing hole pairs may be replaced by a voluntary fixing means for removably fixing the linear member 86-3.

In application to feeding the cut sheets B5, the cassette 80 is assembled as shown in FIG. 14 and, with the B5 sheets installed therein, it is set up in the system.

However, in the application to the cut sheets B4, the side wall member 84 and the rear partition member 87 are removed from the shown state in FIG. 14. Then, respective positions of the bar member 86-1 and the linear members 86-2, 86-3 are changed as necessary, before installtion of the B4 sheets.

Basic operations of the cassette 80 will follow.

Firstly, the cut sheets B5 are accommodated in the cassette 80, by placing them in a neat stacked state on the stack plate 82, to hold the them within the stack zone Z5.

Secondly, the cassette 80 is set up so that the first pickup pawl 85*a* fronts the right transverse end region of the front area of the stack zone Z5 from thereabove, the second pickup pawl 84*a* fronts the left transverse end region of the front area of the stack zone Z5 from thereabove, the spring members normally upwardly bias the stack plate 82, providing the plate 82 with a tendency to upwardly swing, causing the cut sheets B5 to be each rearwardly shifted with a play left between the front periphery thereof and the front wall portion 81*a* of the casing assembly 80, while bringing the front periphery of the top sheet S1 (of B5) into contact with the first and second pickup pawls 85*a*, 84*a*, and the bar and linear members 86-1, 86-2, 86-3 provided on the front portion of the stack plate 82 normally give an upward deformation to an intermediate length of the front periphery of each of the cut sheets B5.

Then, thirdly, the pickup roller (or rollers) is (or are) rotated in the pickup phase of the feed cycle of the system so that the first and second pickup pawls 85*a*, 84*a* frictionally hold both ends of the front periphery of the top sheet S1, giving them twisting tendencies, and the front periphery of the top sheet S1 has along the intermediate length thereof an upwardly deforming tendency induced by each of and intensified by synergism between the upward deformation and the twisting tendencies, as described.

Figure 15:
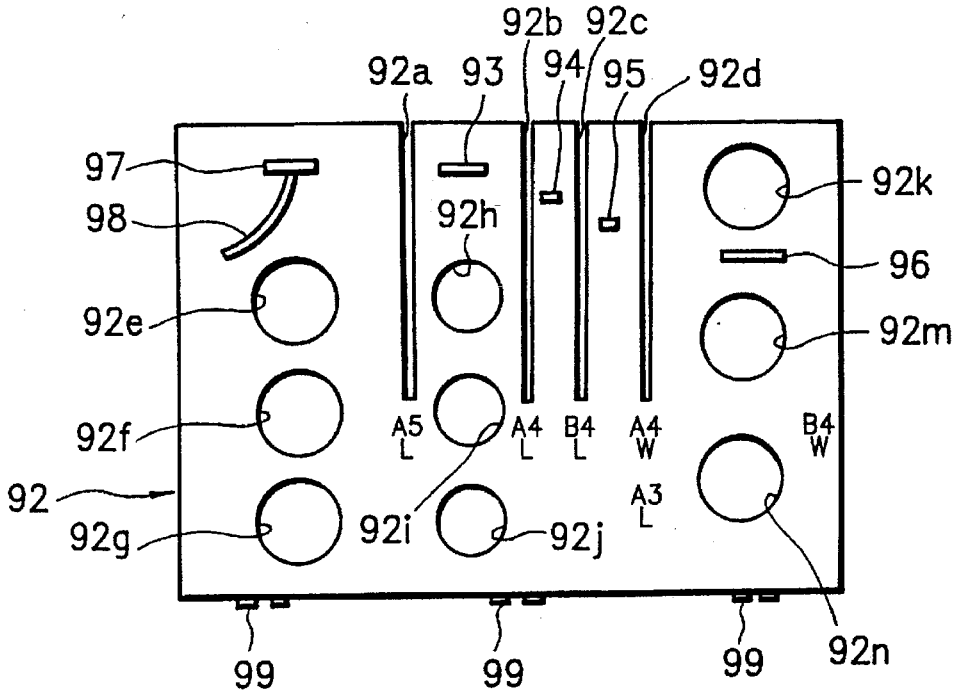
FIG. 15 is a plan view of a stack plate of a cut sheet cassette according to a ninth embodiment of the invention.

FIG. 15 shows a stack plate of a cut sheet cassette according to a ninth embodiment of the invention.

The cassette according to the ninth embodiment includes an unshown casing assembly that is implemented to longitudinally and transversely define a number of stack zones having corresponding total areas to the sheet stack of A5L, A4L, B4L and B4W, on a single stack plate 92. The casing assembly of the ninth embodiment has a similar structure to that of the eighth embodiment, and includes an unshown removable or transversely slidable side wall member. The stack plate 92 thus has cut therein a number of longitudinally extending engagement grooves 92*a*, 92*b*, 92*c*, 92*d* transversely arranged in parallel to be selected for a vertically loose engagement with the side wall member.

The stack plate 92 has formed therethrough a number of longitudinal arrays of round-edged circular holes 92*e*, 92*f*, 92*g*; 92*h*, 92*i*, 92*j*; 92*k*, 92*m*, 92*n* to reduce a total frictional coefficient between the upside of the plate 92 and a bottom sheet of a plurality of cut sheets (hereafter S) neat stacked thereon.

The stack plate 92 has, as convex stripe means thereof, a first bar member 97 slidable along and fixingly attachable to an arbitary point of a cam rightwardly (in front view of the plate 92) curving groove 98 formed in a front portion of the plate 92, within a near region to a right transverse end region of a front area of each of the stack zones.

The stack plate further has a number of second bar members 98, 94, 95, 96 different in length from each other and each detachably fixed to one of a plurality of hidden fixing holes arranged in a substantially leftwardly crossing direction with a longitudinal direction of the cassette, over a far region of the front portion of the plate 92 from the right transverse end region of each stack zone.

Designated at character 99 is one of a plurality of hinge members fixed to a rear end of the stack plate 92. The hinge members 92 are swingably engageable with unshown hinge pieces fixed on a top part of an unshown bench member of a rear wall portion of the casing assembly.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An automatic paper feed device for picking up and feeding a plurality of cut sheets of paper to a recorder, in a one-by-one manner, said paper feed device comprising:

a stack plate for supporting said plurality of cut sheets placed on a paper stacking side thereof;

a spring member provided on a side opposite to said paper stacking side of said stack plate;

a feed roller rotatable to force out said cut sheets one-by-one in a paper feed direction, said forced out sheets being taken from said plurality of cut sheets placed on said stack plate, said spring member urging said stack plate toward said feed roller;

a pawl member for separating said one of said plurality of cut sheets from the rest of said cut sheets, as said feed roller forces said one cut sheet in said paper feed direction; and a convex stripe part provided on said paper stacking side of said stack plate, said convex strip being located at a position along said paper feed direction between said feed roller and said pawl member;

said stripe part extending in a direction transverse to said paper feed direction.

2. An automatic paper feed device according to claim 1, wherein:

said plurality of cut sheets have a reference weight between 60 kg to 90 kg in A series or an equivalent weight thereto; and said stripe part has in section thereof a convex form with a lateral width between 1.0 mm to 2.0 mm and a projection height between 0.3 mm to 0.5 mm over said paper stacking side of said stack plate.

3. An automatic paper feed device according to claim 1, wherein:

said plurality of cut sheets each have a longitudinal dimension of 297 mm and a transverse dimension of 210 mm; and said stripe part is located at a distance between 10.0 mm to 20.0 mm from an edge of said stack plate in said paper feed direction.

4. An automatic paper feed device according to claim 1, wherein said stripe part is formed round at an opposing side thereof to said paper feed direction.

5. An automatic paper feed device according to claim 1, wherein said stripe part comprises a pair of stripe elements symmetrical to each other with respect to a symmetry axis extending in said paper feed direction.

6. An automatic paper feed device according to claim 5, wherein said pair of stripe elements is arranged in a line perpendicular to said symmetry axis.

7. An automatic paper feed device according to claim 5, wherein said pair of stripe elements is arranged so as to taper toward said pawl member.

8. An automatic paper feed device according to claim 5, wherein said pair of stripe elements is arranged so as to taper toward said feed roller.

9. A cut sheet cassette for accommodating therein a plurality of neat stacked cut sheets of paper, said cassette being cooperative with a paper feed system including a pickup roller which is rotatable, in a paper pickup phase of a feed cycle of said system, in frictional contact with a top sheet of said plurality of cut sheets to force the same to slide in a forward sense of a substantially longitudinal direction of said cassette in accord with a paper feed direction of said system, so-that said top sheet can be picked up from said cassette into said system, said cassette comprising:

a casing assembly including a front wall portion formed with a front opening having a slightly smaller transverse width than said plurality of cut sheets, a rear wall portion, and a side wall portion;

a stack plate fitted in said casing assembly, in a vertically swingable manner about a rear edge thereof pivoted to said rear wall portion of said casing assembly;

said stack plate cooperating with said front wall portion, said rear wall portion and said side wall portion of said casing assembly to define a substantially rectangular parallelepiped stack zone for holding therein said plurality of cut sheets, as they are stacked on said stack plate;

a downwardly pointing first pickup pawl fronting either of a pair of transverse end regions of a front area of said stack zone from thereabove:

a downwardly pointing second pickup pawl fronting the other of said pair of transverse end regions of said front area of said stack zone from thereabove;

a spring member for normally upwardly biassing said stack plate, providing the same with a tendency to upwardly swing, causing said plurality of cut sheets to be each rearwardly shifted with a play left between a front periphery thereof and said front wall portion of said casing assembly, while bringing said front periphery of said top sheet into contact with said first and second pickup pawls so that, in said pickup phase of said feed cycle of said system, said first and second pickup pawls frictionally hold both ends of said front periphery of said top sheet, giving them twisting tendencies; and a stripe means provided on a front portion of said stack plate, for normally giving an upward deformation to an intermediate length of said front periphery of each of said plurality of cut sheets so that, in said pickup phase of said feed cycle of said system, said front periphery of said top sheet has along said intermediate length thereof an upwardly deforming tendency induced by each of and intensified by synergism between said upward deformation and said twisting tendencies, wherein:

said stripe means comprises a bar member fixed to said front portion of said stack plate, said bar member extending in a crossing direction with respect to said longitudinal direction of said cassette;

said stack plate has in said front portion thereof a plurality of central fixing means arranged substantially in a crossing direction with respect to said longitudinal direction of said cassette; and said bar member is detachably fixed to one of said plurality of central fixing means.

10. A cut sheet cassette according to claim 9, wherein:

said stack plate further has in said front portion thereof a plurality of first auxiliary fixing means arranged substantially in another crossing direction with said longitudinal direction of said cassette within a neighboring region to said either transverse end region of said front area of said stack zone, and a plurality of second auxiliary fixing means arranged substantially in still another crossing direction with said longitudinal direction of said cassette within a neighboring region to said other transverse end region of said front area of said stack zone; and said stripe means further comprises a first linear member detachably fixed to one of said plurality of first auxiliary fixing means, and a second linear member detachably fixed to one of said plurality of second auxiliary fixing means.

11. A cut sheet cassette according to claim 9, wherein:

said casing assembly further includes a removable side wall member;

said first pickup pawl is formed on a transverse end of said front wall portion; and said second pickup pawl is formed on a front end of said side wall member.

12. A cut sheet cassette according to claim 11 wherein:

said cassette further comprises a downwardly pointing third pickup pawl formed on another transverse end of said front wall portion of said casing assembly;

said casing assembly further includes another side wall portion and a bottom wall portion;

said rear wall portion of said casing assembly comprises a rear wall member fixed to said bottom wall portion, a bench member fitted on said bottom wall portion, and a rear partition member removably fitted on a front part of said bench member;

said stack plate is pivoted at said rear edge thereof to said front part of said bench member; and said stack zone has a variable total area at least between a first total area defined by a combination of said front wall portion, said side wall portion, said another side wall portion and said rear wall member and a second total area defined by a combination of said front wall portion, said side wall portion, said side wall member and said rear partition member.

13. A cut sheet cassette for accommodating therein a plurality of neatly stacked cut sheets of paper, said cassette being cooperative with a paper feed system including a pickup roller which is rotatable, in a paper pickup phase of a feed cycle of said system, said pick up roller being in frictional contact with a top sheet of said plurality of cut sheets in order to force the top sheet to slide in a forward sense along a substantially longitudinal direction of said cassette in accord with a paper feed direction of said system, so that said top sheet can be picked up from said cassette and feed into said system, said cassette comprising:

a casing assembly including a front wall portion formed with a front opening having a width that is a slightly smaller transverse than a width of said plurality of cut sheets, a rear wall portion, and a side wall portion;

a stack plate fitted in said casing assembly, to swing in a vertical manner about a rear edge thereof, said stack wall being pivotally coupled to said rear wall portion of said casing assembly;

said stack plate cooperating with said front wall portion, said rear wall portion and said side wall portion of said casing assembly to define a substantially rectangular parallelepiped stack zone for holding said plurality of cut sheets therein as they are stacked on said stack plate;

a downwardly pointing first pickup pawl confronting either one of a pair of transverse end regions at a front area of said stack zone from thereabove;

a downwardly pointing second pickup pawl confronting the other of said pair of transverse end regions of said front area of said stack zone from thereabove;

a spring member for normally biassing said stack plate upwardly, said spring bias providing the stack plate with a tendency to swing upwardly, causing each of said plurality of cut sheets to be rearwardly shifted with a play left between a front periphery thereof and said front wall portion of said casing assembly, while bringing said front periphery of said top sheet into contact with said first and second pickup pawls so that, in said pickup phase of said feed cycle of said system, said first and second pickup pawls frictionally hold both ends of said front periphery of said top sheet, giving them a twisting tendency; and a stripe means provided on a front portion of said stack plate, said stripe means normally giving an upward deformation to an intermediate length of said front periphery of each of said plurality of cut sheets so that, in said pickup phase of said feed cycle of said system, said front periphery of said top sheet has along said intermediate length thereof an upwardly deforming tendency induced by each of and intensified by synergism between said upward deformation and said twisting tendencies, wherein:

said stack zone has a variable total area; and said stripe means comprises a first bar member slidable along a cam groove formed in said front portion of said stack plate, within a near region thereof to either of said pair of transverse end region of said front area of said stack zone, and a second bar member detachably fixed to one of a plurality of fixing means arranged in a substantially crossing direction with respect to said longitudinal direction of said cassette, over a far region of said front portion of said stack plate from either of said pair of transverse end regions of said front area of said stack zone.

* * * * *